US008887972B2

(12) United States Patent
Solomon

(10) Patent No.: US 8,887,972 B2
(45) Date of Patent: Nov. 18, 2014

(54) RELEASABLE MAGAZINE POUCH

(71) Applicant: Alliant Techsystems Inc., Minneapolis, MN (US)

(72) Inventor: Sean Solomon, Concord, NH (US)

(73) Assignee: Alliant Techsystems Inc., Minneapolis, MN (US)

( * ) Notice: Subject to any disclaimer, the term of this patent is extended or adjusted under 35 U.S.C. 154(b) by 39 days.

(21) Appl. No.: 13/691,617

(22) Filed: Nov. 30, 2012

(65) Prior Publication Data

US 2013/0248566 A1 Sep. 26, 2013

Related U.S. Application Data

(60) Provisional application No. 61/565,046, filed on Nov. 30, 2011.

(51) Int. Cl.
*F42B 39/26* (2006.01)
*F42B 39/02* (2006.01)
*F42B 39/22* (2006.01)

(52) U.S. Cl.
CPC ..... *F42B 39/26* (2013.01); *F42B 39/02* (2013.01); *F42B 39/22* (2013.01); *Y10S 224/931* (2013.01)
USPC ..... 224/245; 224/931

(58) Field of Classification Search
CPC ..... F42B 39/002; F42B 39/26
USPC ..... 224/239, 931, 242, 243, 244, 245; 42/90
See application file for complete search history.

(56) References Cited

U.S. PATENT DOCUMENTS

| | | | | | |
|---|---|---|---|---|---|
| 4,597,213 | A * | 7/1986 | Musgrave | 42/90 |
| 4,799,323 | A * | 1/1989 | Musgrave | 42/90 |
| 5,174,482 | A | 12/1992 | Rogers et al. | |
| 5,261,583 | A * | 11/1993 | Long et al. | 224/245 |
| 6,000,589 | A * | 12/1999 | Burdine | 224/196 |
| 6,059,157 | A * | 5/2000 | Parsons et al. | 224/251 |
| 6,154,997 | A * | 12/2000 | Aluotto et al. | 42/90 |
| 6,202,908 | B1 | 3/2001 | Groover | |
| 7,364,057 | B2 * | 4/2008 | Carroll | 224/196 |
| D574,147 | S * | 8/2008 | Zusman | D3/222 |
| 7,614,534 | B2 | 11/2009 | Veo et al. | |
| 7,918,371 | B2 | 4/2011 | Wilson | |
| 7,950,552 | B2 * | 5/2011 | Fan | 224/243 |
| 8,104,640 | B2 * | 1/2012 | Selvetti | 221/154 |
| 8,231,038 | B2 * | 7/2012 | Felts | 224/665 |
| 8,733,606 | B2 * | 5/2014 | Felts | 224/671 |
| 2004/0200111 | A1 | 10/2004 | Horn | |
| 2007/0039989 | A1 * | 2/2007 | Nistico | 224/674 |
| 2007/0278269 | A1 | 12/2007 | Rogers et al. | |
| 2008/0023509 | A1 | 1/2008 | Lowe | |
| 2013/0098935 | A1 * | 4/2013 | Sheffield | 221/1 |

* cited by examiner

*Primary Examiner* — Justin Larson
(74) *Attorney, Agent, or Firm* — Christensen Fonder P.A.

(57) ABSTRACT

A magazine pouch having slots for receiving a magazine having a conventional magazine notch engagable by the magazine catch assembly of firearm to retain the magazine within the magazine well of the firearm. The magazine pouch having a shuttle slidable to engage a retention element with a hook portion to move the hook portion into the slot such that the hook portion engages the magazine notch. The engagement of the hook portion to magazine notch retains the magazine within the slot during movement of an individual wearing the magazine pouch. The shuttle can be slid out of engagement with the hook portion to disengage the hook portion from the magazine notch allowing removal of the magazine.

32 Claims, 19 Drawing Sheets

RELEASABLE MAGAZINE POUCH

RELATED APPLICATION

The present application claims the benefit of U.S. Provisional Application No. 61/565,046 entitled RELEASABLE MAGAZINE POUCH and filed Nov. 30, 2011, which is incorporated herein in its entirety by reference.

FIELD OF THE INVENTION

The present invention relates to the field of wearable magazine pouches that receive magazines and retain the magazines during movement of the wearer of the magazine pouch.

BACKGROUND OF THE INVENTION

Individuals often carry firearms and ammunition on their persons to provide ready access to a loaded firearm for a variety of reasons such as competition, personal protection or professional requirements (e.g. law enforcement, security services, military). Firearms, and in particular handguns, are typically carried within a holster worn by the individual that define a pouch for receiving and having a handle strap or other engagement mechanism for retaining the firearm until the firearm is removed from the holster by the individual. Similarly, spare ammunition for the firearm is typically carried within magazine pouches worn by the individual's clothing or attached to equipment carried by the individual. Ammunition for rifles, pistols and certain shotguns are typically pre-loaded into detachable box magazines for efficiently carrying a plurality of cartridges as well as for efficiently loading multiple cartridges into the firearm at a time. Box magazines generally comprise a metal or rigid polymer box for receiving the cartridges and a spring assembly for sequentially positioning the cartridges at the mouth of the box for loading into the action of the fire arm. In order to organize the ammunition within the magazine pouch and reduce time searching for a magazine, magazine pouches frequently comprise a plurality of pockets each sized to receive a single magazine.

A primary concern for transporting magazines in a magazine pouch is balancing the need for securely retaining the magazines within the pockets during movement of the individual while still presenting the magazines for easy access. Many individuals who carry firearms in professional capacities, such as law enforcement and military, often carry firearms and ammunition may have cause to engage in a variety of intensive physical movements such as running, climbing over obstacles, rolling on the ground or even grappling with another individual. Accordingly, the magazine pouch must securely retain the magazines within the pockets in spite of the movement of the wearer to avoid dislocation or losing the magazines during the movement of the wearer. A competing concern is that these individuals also often require ready access to the magazines for quick reloading of the firearm. The extra time required to perform the additional hand actions required to disengage a complex magazine retention mechanism on the pocket can mean the difference between life and death. An added concern is that the individual is often reaching for the magazine without looking at the magazine pouch to maintain their focus on the target and surroundings. A complex or small locking mechanism can be difficult to locate and operate blindly.

Accordingly, magazine pouches often simply comprise pockets sized to closely approximate the size of the box to retain the magazine with a friction fit. The pockets are often oriented such that the opening of the pocket faces upwards when the pouch is worn by the individual. This approach positions the rear end of the magazine where it can be easily gripped and pulled from the pocket. However, movement of the wearer can overcome friction fit causing the magazine to inadvertently slip from the pocket. Moreover, the upright orientation also limits the possible attachment points for the magazine pouch to the belt. Accordingly, the pockets can also often comprise a flap that can be folded over the end of the magazine or the pocket opening and secured with a releasable fastener such as a button, VELCRO or magnets. The flap improves the retention of the magazines, but adds an additional hand action of lifting the flap before gripping the magazine. Moreover, once opened, the flap can create a hindrance or distraction impeding the individual's hand as they reach for the magazine.

Another approach to securing magazines within a pocket is a flexible tab having a hooked end portion that engages the end of the magazine to retain the magazine within the pouch as disclosed in US Patent Publication No. 2008/0023509. The tab can be flexed by the individual to disengage the hooked portion from the magazine and remove the magazine. The drawback of this approach is that the individual must locate the tab and properly flex the tab to disengage the hooked portion, which can be challenging while blindly reaching for the magazine or during the pressure of a firefight or competition.

A similar approach is a magazine pouch having leaves that can be folded closed to define a pouch for receiving magazine as disclosed in U.S. Pat. No. 7,614,534. The leaves are held closed by a top flap and secure a magazine within the pocket. The top flap is lifted to release the leaves and allow the magazine to be pulled from the pouch, wherein the leaves are adapted to open when the magazine is pulled on by the individual. The drawback of the approach is that individual must first disengage the top flap before gripping the magazine to disengage the leaves and remove the magazine. The multiple hand actions required to release the magazine slows the reload time and increases the likelihood that the individual will perform the procedure incorrectly leaving the magazine secured within the pocket. Moreover, the multiple moving parts of the pouch increase the likelihood that a portion of the assembly will fail to engage or disengage leaving the magazine trapped or dropping the magazine inadvertently. The multiple moving parts may also become caught on clothing or equipment jamming the mechanisms and preventing release of the magazines.

Yet another approach is affixing or integrating a clip onto the magazine itself that can be used to directly attach the magazine to the wearer's clothing or belt as disclosed in US Patent Publication No. 2004/0200111. This approach requires that the clip be positioned at a point on the magazine that will not interfere with the loading of the magazine into the firearm. With elongated box magazines, the clips can be positioned at the end or bottom portion of the magazine that remains outside the magazine well. However, this approach is often incompatible with many pistols and other firearms in which the entire or nearly the entire magazine fits within the magazine well. Moreover, locating the disengagement mechanism of the clip can be difficult, particularly in a high stress situation such as a firefight or competition.

These prior approaches illustrate that there exists an ongoing need for a means of securely retaining magazines while still presenting the magazines to the individual in an easily accessible manner.

SUMMARY OF THE INVENTION

A magazine pouch, according to an embodiment of the present invention, comprises a magazine housing, a shuttle and a retention element with a movable hook or engagement portion on a flexible arm or cantilevered leaf spring. The magazine housing defines a slot for receiving one end of magazine having a conventional magazine notch engagable by the magazine catch assembly of firearm to retain the magazine within the magazine well of the firearm. The slot is sized such that the opposite end of the magazine protrudes from the slot allowing individuals to grip the exposed end of the magazine and pull the magazine from the slot. In one embodiment, the pouch can comprise a main body having plurality of magazine housings each defining a slot for receiving a magazine. The shuttle can be positioned to engage the hook portion and flex the flexible arm to move the hook portion into the slot such that the hook portion engages the magazine notch. Similarly, the shuttle can be positioned to obstruct the hook portion preventing the flexible arm to move the hook portion out of engagement with the magazine. The engagement of the hook portion to magazine notch retains the magazine within the slot during movement of an individual wearing the magazine pouch. The retention element securely retains the magazine with the same mechanism employed by the firearm to secure the magazine in the magazine well of the firearm providing an equally effective means securing the magazine without requiring modification of the magazine.

Similarly, the shuttle can be slid by the individual along a linear path of travel parallel to the flexible arm until the shuttle disengages the hook portion allowing the hook portion to move out of the slot and disengage the magazine notch, wherein the flexible arm is biased to move the hook portion out of engagement with the magazine notch when the hook portion is disengaged by the shuttle. In one embodiment, a button can be affixed to the shuttle allowing the individual to slide the shuttle along the linear path of travel by depressing the button. The button can be positioned such that an individual can depress the button while gripping the exposed end of the magazine allowing for disengagement and removal of the magazine from the slot without changing grip. The button can also be oversized to be easily located and depressed by the individual. In one embodiment, a spring can be positioned beneath the shuttle to return the shuttle into engagement with the hook portion when the button is released In one embodiment of the present invention, the shuttle can comprise a secondary spring engaging the hook portion of the retention element. The secondary spring can be tensioned such that the engagement of the hook portion with the secondary spring presses the hook portion into engagement with the magazine notch when the shuttle is positioned to engage the hook portion. The secondary spring provides a flexible engagement with the hook portion allowing the hook portion limited movement when the shuttle is positioned to engage the hook portion. In this configuration, sliding the magazine into the slot can push the hook portion out of the engagement position until the magazine notch aligns with the hook portion, wherein the tension on the spring pushes the hook portion into engagement with the magazine notch when the notch is aligned with the hook portion. In one embodiment, the hook portion can comprise a rounded, tapered or inclined surface engagable by the edge of the magazine to move the hook portion out of the engagement position. This arrangement allows a magazine to be loaded into the slot and automatically secured without movement of the shuttle. In certain embodiments, when the shuttle is positioned in the obstructing position, the magazine can be removed by applying a pull force to the magazine overcoming the tension applied by the secondary spring to deflect the secondary spring and move the engagement feature out of the retention position.

In one embodiment of the present invention, the magazine pouch can further comprise an attachment buckle attachable to the main body of the magazine pouch. The attachment buckle can comprise belt loops, engagement points for a holster platform, sling mounts for a shoulder harness or carrying the magazines in a generally horizontal orientation and other engagement means for securing the magazine pouch to clothing or equipment. In one embodiment, the attachment buckle further comprises a wall encircling the retention elements and shuttles to contain the moving components beneath the attachment buckle and within the walls to avoid the shuttle or the retention elements from catching on clothing or loose equipment and preventing release of the magazine.

A magazine pouch, according to an embodiment of the present invention, comprises a main body having at least one magazine housing and a catch assembly corresponding to each magazine housing. Each magazine housing defines a slot for receiving an end of a magazine having a magazine notch such that a portion of the magazine protrudes from the slot. Each catch assembly further comprises at least one retention element and a shuttle. The retention element comprises a hook portion on a flexible arm, wherein flexing the arm can move the hook portion between an engaged position in which the hook portion intersect the slot and a disengaged position in which the hook portion retracts out of the slot. The shuttle is slidable along a linear path of travel parallel to the flexible arm into a locked position in which the shuttle engages the hook portion to bend the flexible arm moving the hook portion into the engaged position. The shuttle is also slidable along the linear path of travel by the individual from the locked position into an unlocked position in which the shuttle is disengaged from the hook portion, wherein the flexible arm is biased to move the hook portion into the disengaged position when the hook portion is disengaged from the shuttle.

A magazine pouch for receiving a magazine, according to an embodiment of the present invention, can comprise at least one magazine housing and a catch assembly corresponding to each magazine housing. Each magazine housing defines a slot for receiving a portion of the magazine. The catch assembly can further comprise a retention element having an engagement feature movable along a first path of travel and a shuttle element movable in along a second path of travel transverse to the first path of travel. The engagement feature is movable along the first path of travel between a retention position in which the engagement feature is intersects the magazine to engage an edged portion of the magazine such as the magazine notch or base and a release position in which the engagement feature is positioned out of engagement with the magazine. The shuttle element is movable between an obstructing position in which the shuttle element engages the retention element to position the engagement feature in the retention position and a non-obstructing position in which the shuttle element is disengaged from the engagement feature allowing the engagement feature to be positioned in the release position.

In one embodiment, the retention element can comprise a flexible arm cantilevered from a single engagement point with the main body at one end of the flexible arm, wherein the engagement feature is positioned at the opposite end of the flexible arm. In another embodiment, the flexible arm can be flexibly secured to the main body at both ends, wherein the engagement feature is positioned between the ends of the flexible arm. In yet another embodiment, the retention element can comprise a detent containing a ball movable in the second path of travel from engagement of the ball with the shuttle element.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
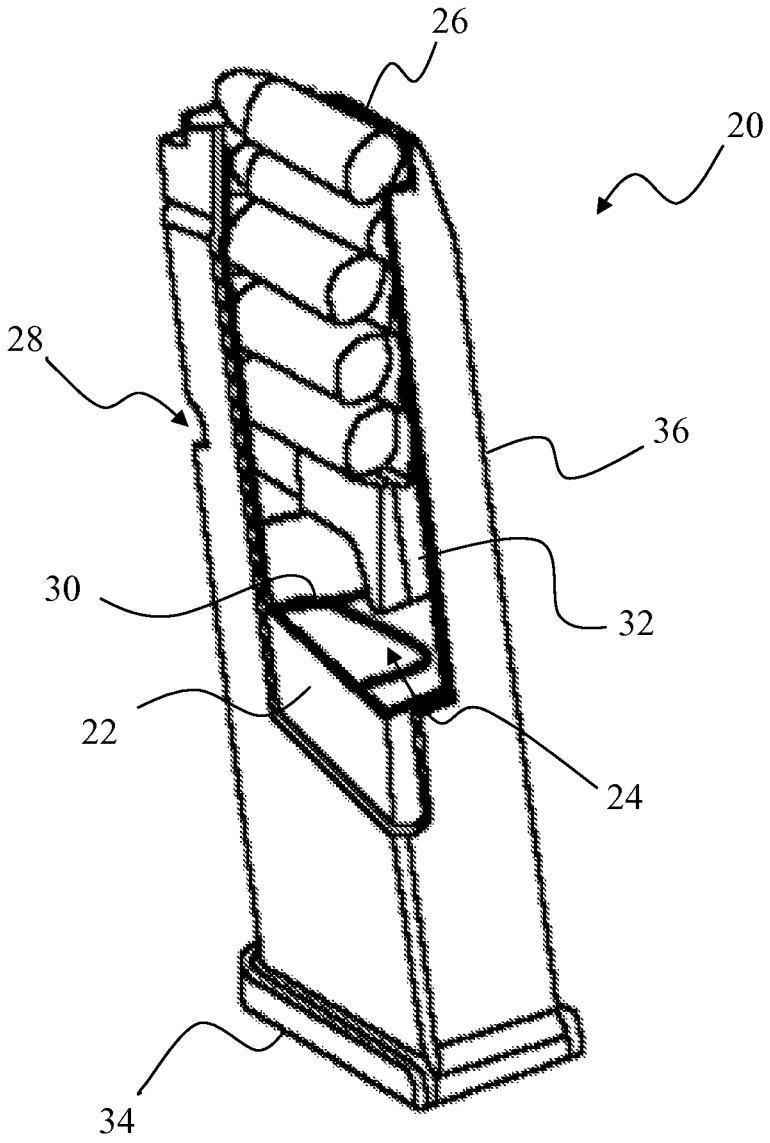
FIG. 1 is a perspective view of a magazine for use with the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As depicted in FIG. 1, a magazine 20 for use with the present invention generally comprises an elongated box 22 and a spring assembly 24. The box 22 defines an interior space for receiving a single or double stacked column of cartridges and further comprises a mouth 26 for accessing the interior space. The box 22 also defines at least one magazine notch 28 engagable by the magazine catch assembly of a firearm when the magazine is inserted into the magazine well of the firearm. In certain embodiments, the box 22 can comprise a protrusion engagable by the magazine catch assembly of the firearm instead of a notch. The spring assembly 24 can further comprise at least one spring 30 biased to push the stacked cartridge column against the mouth 26 of the box 22 such that a new cartridge is pushed into the mouth 26 of the box 22 as the previous cartridge is stripped from the top of the column during chambering of the cartridge for firing. The spring assembly 24 can further comprise a follower 32 positioned between the spring 30 and the cartridge column for evenly elevating the cartridge column as the column is diminished. In one embodiment, the magazine 20 can further comprise a base 34 affixed to the box 22 opposite the mouth 26. In one embodiment, the magazine 20 can further comprise a polymer coating 36 for improving the durability of the magazine 20. As depicted, the magazine 20 comprises a pistol magazine. The present invention can be adapted for use with box magazines for other firearms. The description of the magazine 20 is not intended to be limiting, but rather to aid in the description of the present invention.

As depicted in FIGS. 2-6 and 8-9, a magazine pouch 40, according to an embodiment of the present invention, comprises a main body 42 having at least one magazine housing 44 each defining a slot 46 for receiving a magazine 20. In one embodiment, the magazine pouch 40 comprises a plurality of magazine housings 44 with a space 45 positioned between the adjacent housings 44. In one embodiment, each magazine housing 44 can comprise a rigid material resistant to deformation upon insertion of the magazine 20 into slot 46. In this configuration, each magazine housing 44 can comprise a polymer comprising high density polyethylene, low density polyethylene, polyvinyl chloride, polyamides, acrylonitrile butadiene styrene polymers, polyketones, polyvinyl toluene, polyesters, polystyrene or other durable polymers. The magazine housing 44 can also comprise composite material or a metal. The magazine pouch 40 also comprises at least one catch assembly 50 corresponding to each magazine housing 44. Each catch assembly 50 further comprises at least one retention element 48, a catch assembly housing 54 and a shuttle 52. Each retention element 48 comprises a hook portion 56 acting as an engagement member and a flexible arm 58. The catch assembly housing 54 comprises at least one rail 60 engagable by the shuttle 52 such that the shuttle 52 can slide along the rail 60, wherein the rail 60 defines a linear path of travel parallel to the flexible arm 58 of the corresponding retention element 48. In one embodiment, the shuttle 52 can comprise a runner 62 slidably interfacing with the rail 60.

Figure 7A:
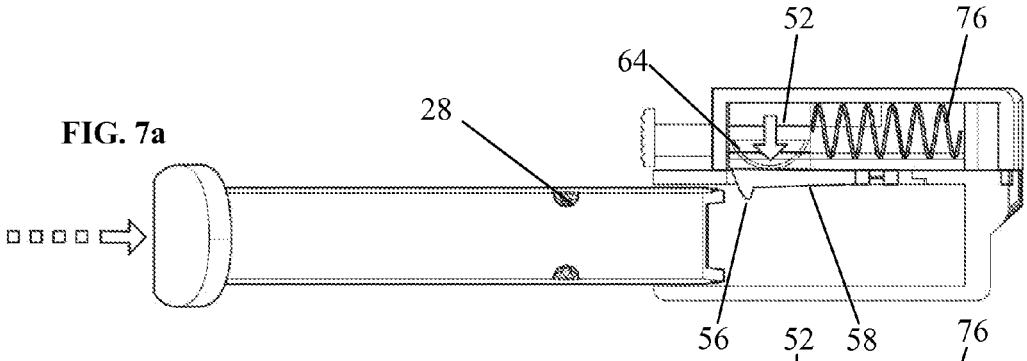
FIG. 7A is a side view of a magazine pouch and a catch assembly according to an embodiment of the present invention with the shuttle positioned in the unlocked position and the magazine being initially loaded into a slot.
Figure 7B:
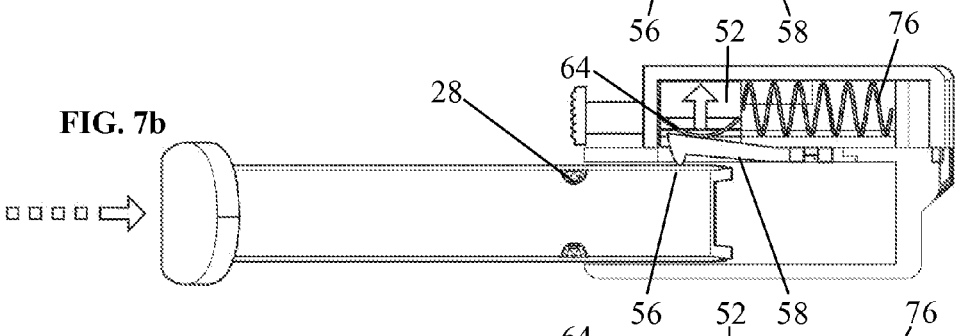
FIG. 7B is a side view of a magazine pouch and a catch assembly according to an embodiment of the present invention with the shuttle positioned in the unlocked position and the magazine being loaded into a slot such that magazine pushes a hook portion out of the engagement position.
Figure 7C:
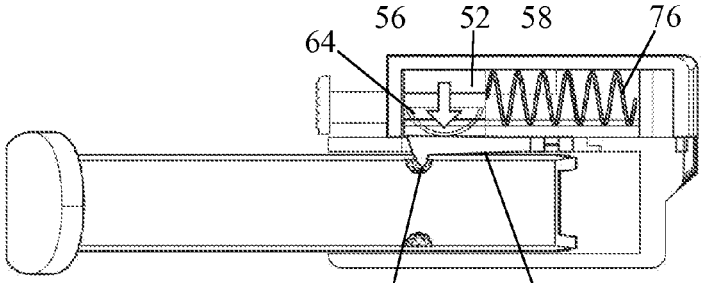
FIG. 7C is a side view of a magazine pouch and a catch assembly according to an embodiment of the present invention with the shuttle positioned in the locked position.
Figure 7D:
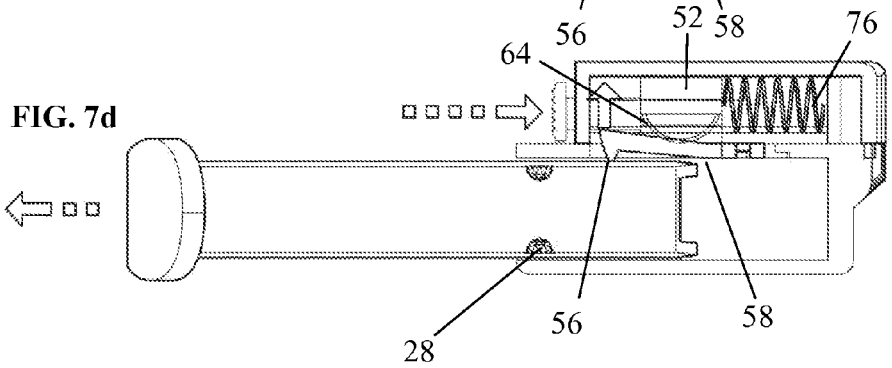
FIG. 7D is a side view of a magazine pouch and a catch assembly according to an embodiment of the present invention with the shuttle positioned in the unlocked position and the magazine being drawn from a slot.
Figure 12A:
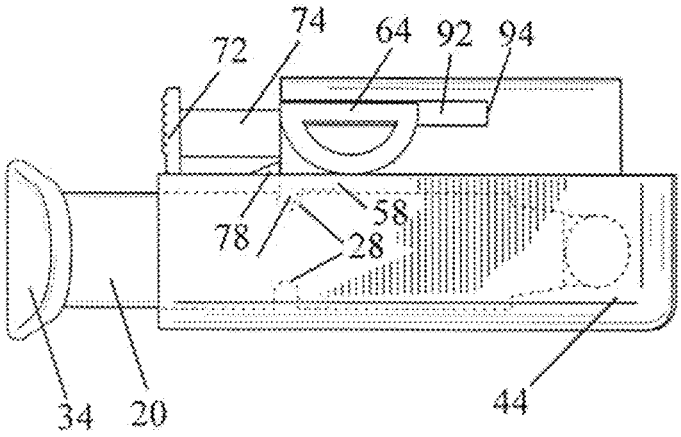
FIG. 12A is a side view of a magazine pouch and a catch assembly according to an embodiment of the present invention with the shuttle positioned in the locked position.
Figure 12B:
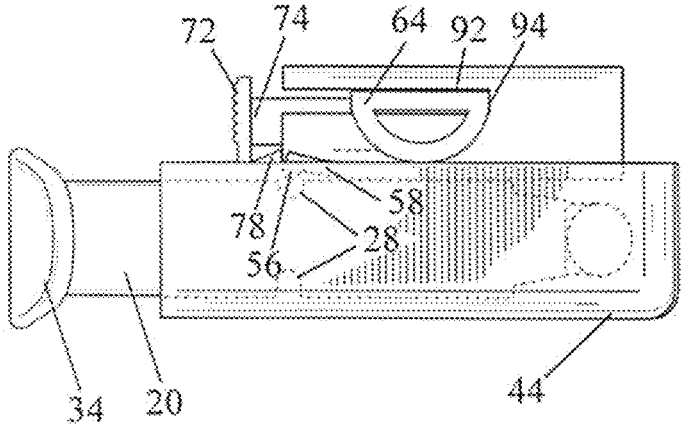
FIG. 12B is a side view of a magazine pouch and a catch assembly according to an embodiment of the present invention with the shuttle positioned in the unlocked position.
Figure 12C:
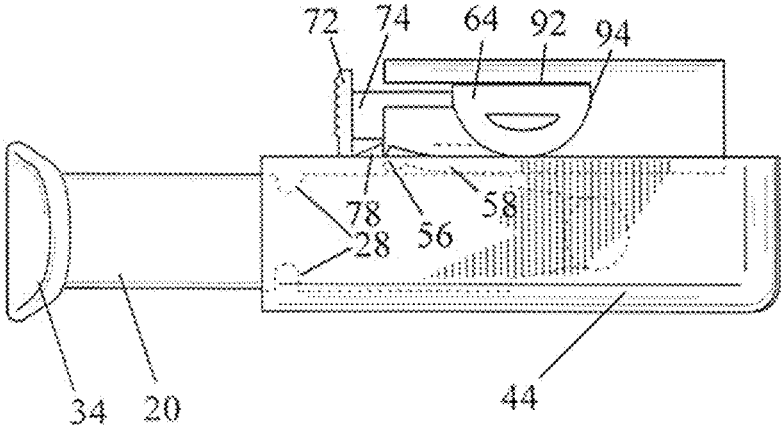
FIG. 12C is a side view of a magazine pouch and a catch assembly according to an embodiment of the present invention with the shuttle positioned in the unlocked position and the magazine being drawn from a slot.
Figure 13A:
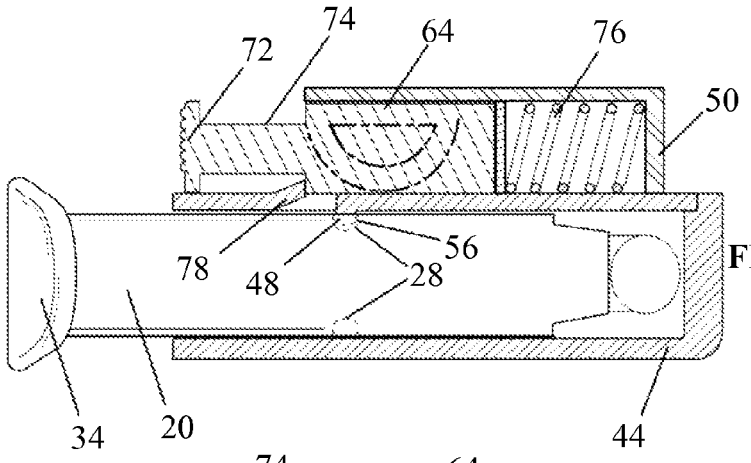
FIG. 13A is a cross-sectional side view of a magazine pouch and a catch assembly according to an embodiment of the present invention with the shuttle positioned in the locked position.
Figure 13B:
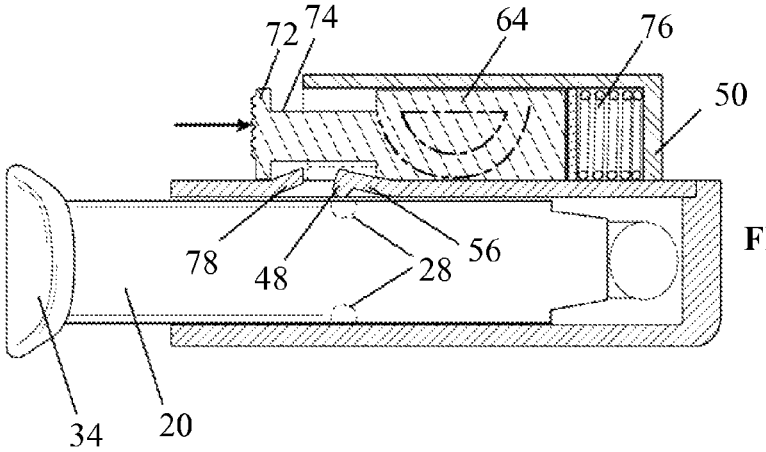
FIG. 13B is a cross-sectional side view of a magazine pouch and a catch assembly according to an embodiment of the present invention with the shuttle positioned in the unlocked position.
Figure 13C:
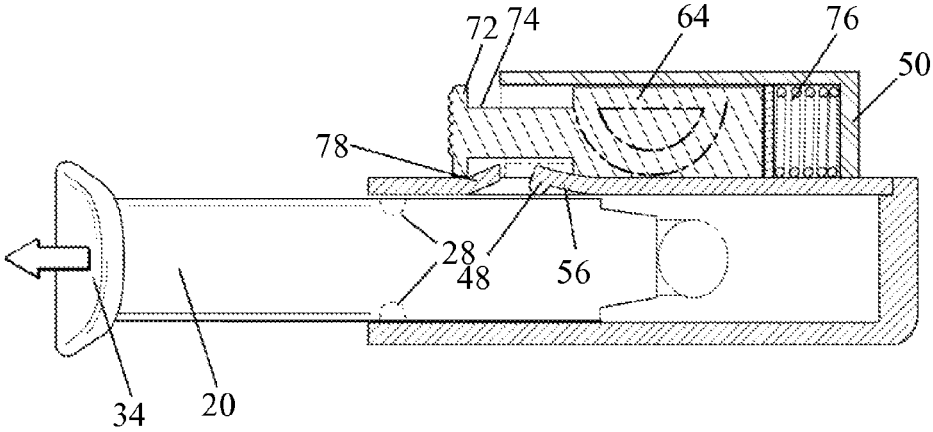
FIG. 13C is a cross-sectional side view of a magazine pouch and a catch assembly according to an embodiment of the present invention with the shuttle positioned in the unlocked position and the magazine being drawn from a slot.
Figure 14A:
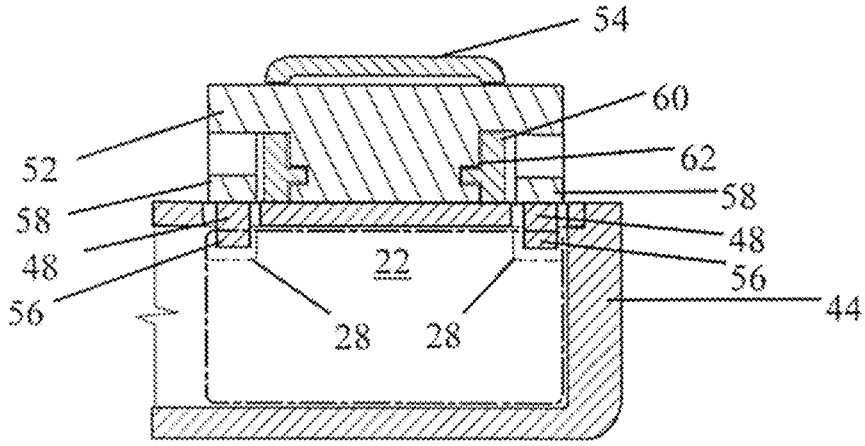
FIG. 14A is a front cross-sectional view of a magazine pouch and a catch assembly with the shuttle position din the locked position.
Figure 14B:
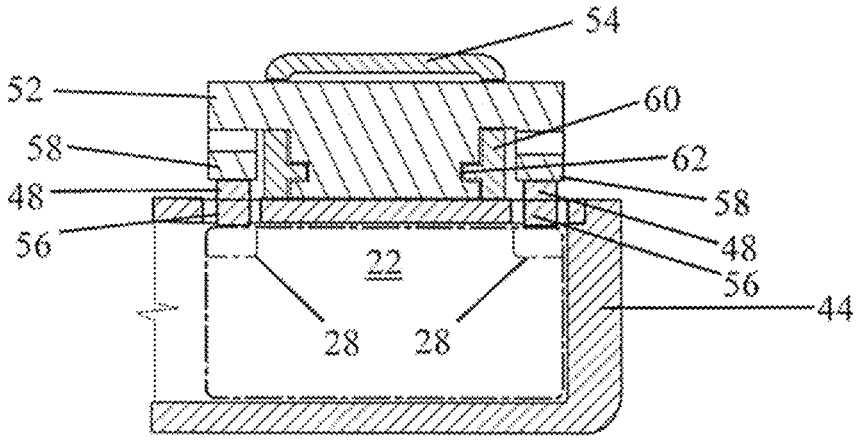
FIG. 14B is a front cross-sectional view of a magazine pouch and a catch assembly with the shuttle position din the unlocked position.
Figure 15:
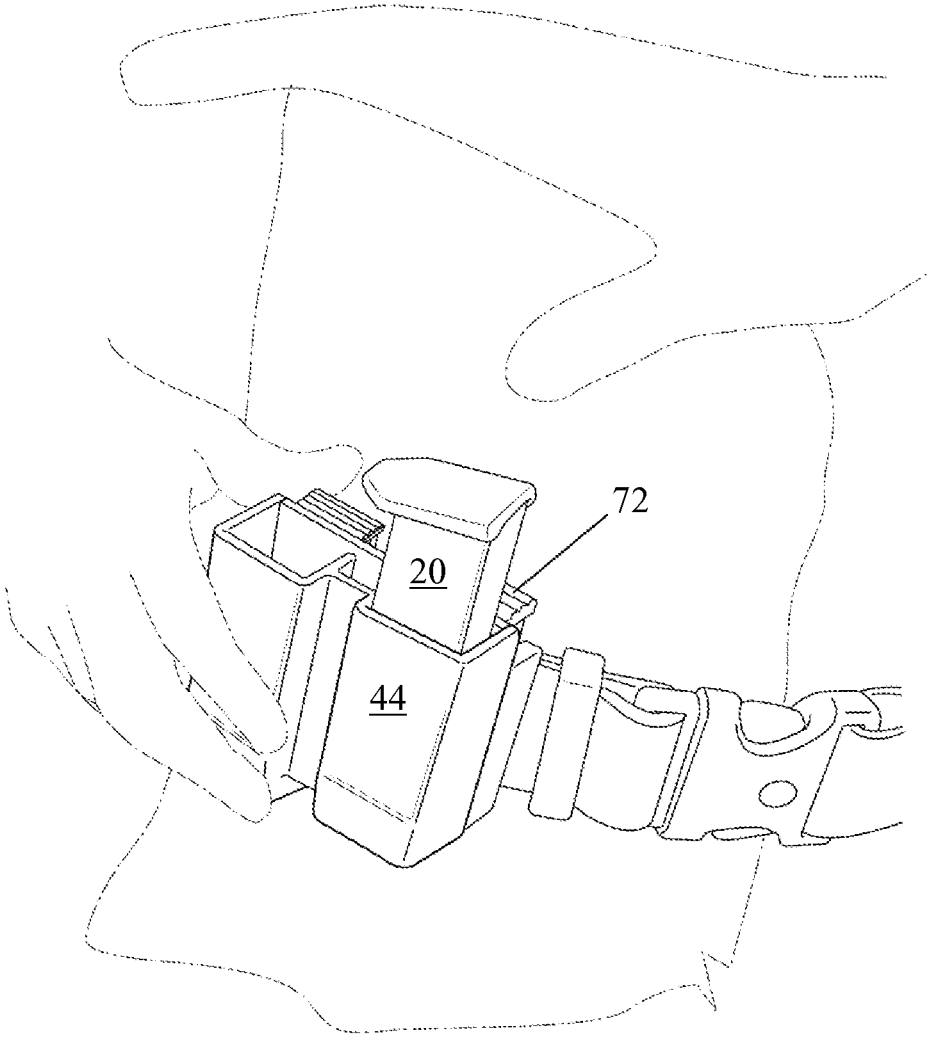
FIG. 15 is a perspective view of the magazine pouch according to an embodiment of the present invention worn by an individual with the magazine in a fixed position.
Figure 16:
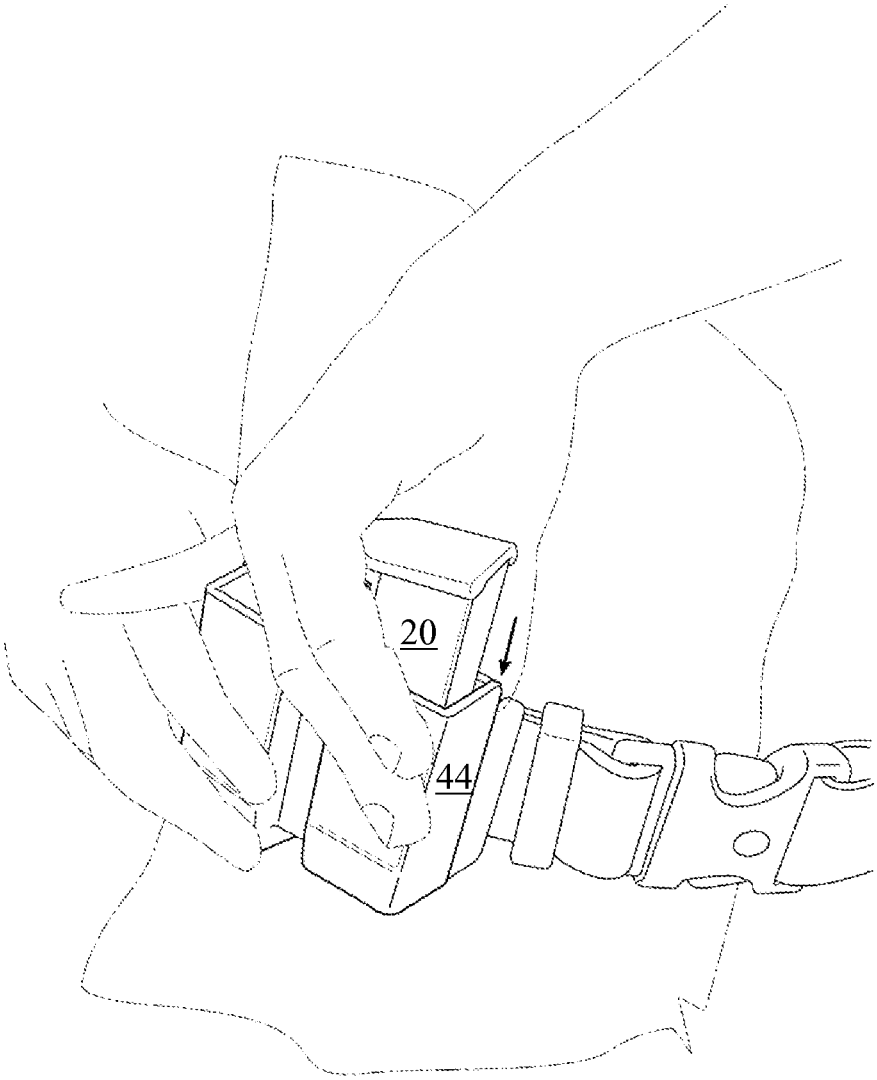
FIG. 16 is a perspective view of the magazine pouch according to an embodiment of the present invention with the button depressed to allow for removal of the magazine from the slot.
Figure 17:
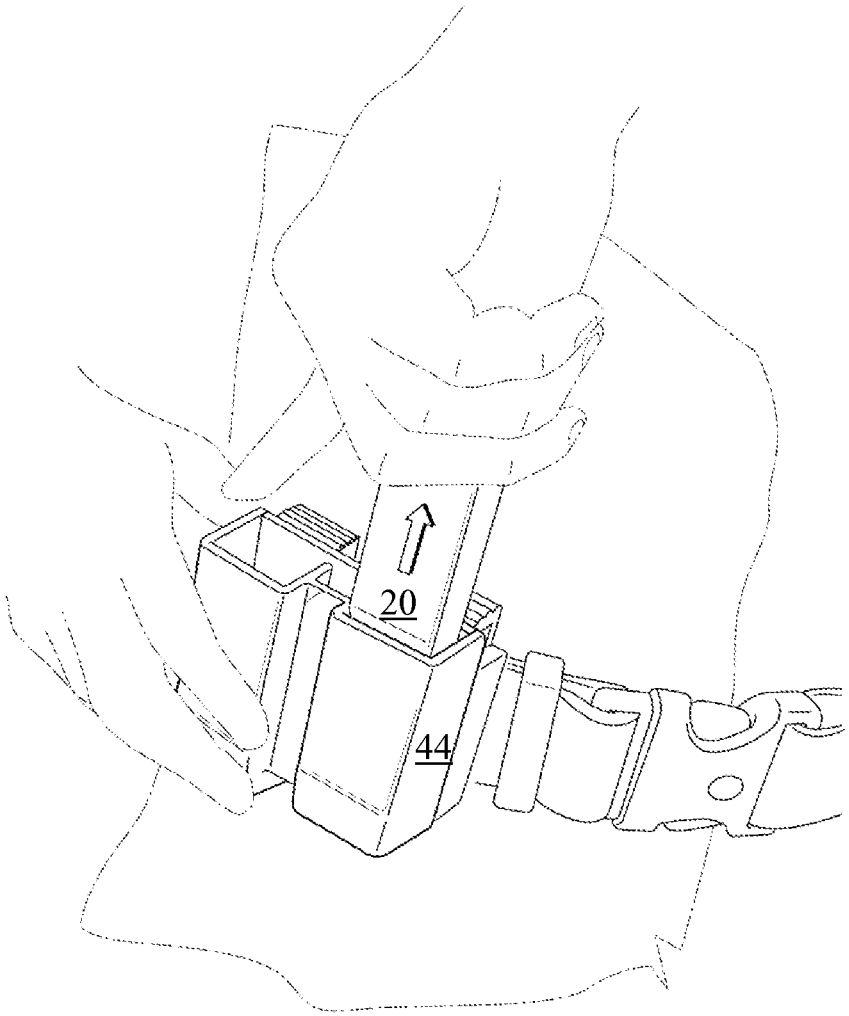
FIG. 17 is a perspective view of the magazine pouch according to an embodiment of the present invention wherein the magazine is removed from the pouch.

As depicted in FIGS. 7*a*-7*d*, 12*a*-12*c* and 13*a*-13*c*, the flexible arm 58 can be flexed to move the hook portion 56 between an engaged or retention position in which the hook portion 56 extends into the slot 46 and a disengaged or release position in which the hook portion 56 is retracted from the slot 46, wherein the flexible arm 58 is biased to position the hook portion 56 in the disengaged position. The hook portion 56 is moved between the engaged position and the disengaged position by sliding the shuttle 52 along the linear path of travel defined by the rail 60 between a locked or obstructing position and an unlocked or non-obstructing position. In the locked or obstructing position, the shuttle 52 engages the hook portion 56 to flex the flexible arm 58 and position the hook portion 56 in the engaged position as depicted in FIGS. 7*c*, 12*a* and 13*a*. The shuttle 52 obstructs the hook portion 56 preventing the flexible arm 58 from moving the hook portion 56 into the disengaged or release position. Similarly, in the unlocked position, the shuttle 52 is disengaged from the hook portion 56 to remove the obstruction preventing the flexible arm 58 to relax and position the hook portion 56 in the disengaged position as depicted in FIGS. 7*d*, 12*b*-12*c* and 13*b*-13*c*.

Figure 20:
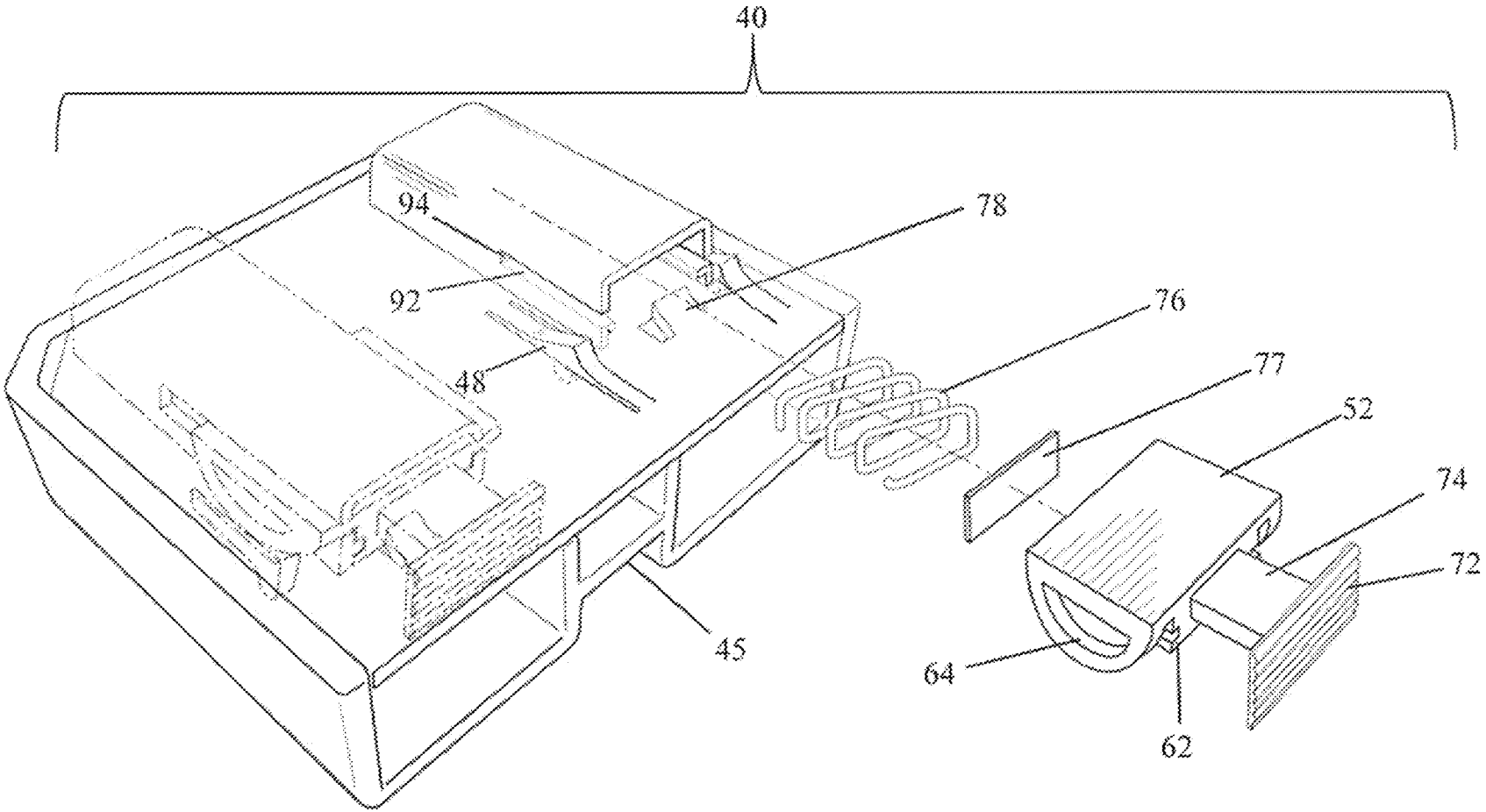
FIG. 20 is a partially exploded perspective view of a magazine pouch according to an embodiment of the present invention in which a flexible arm of a retention element is attached to a main body of the magazine pouch at both ends.
Figure 21:
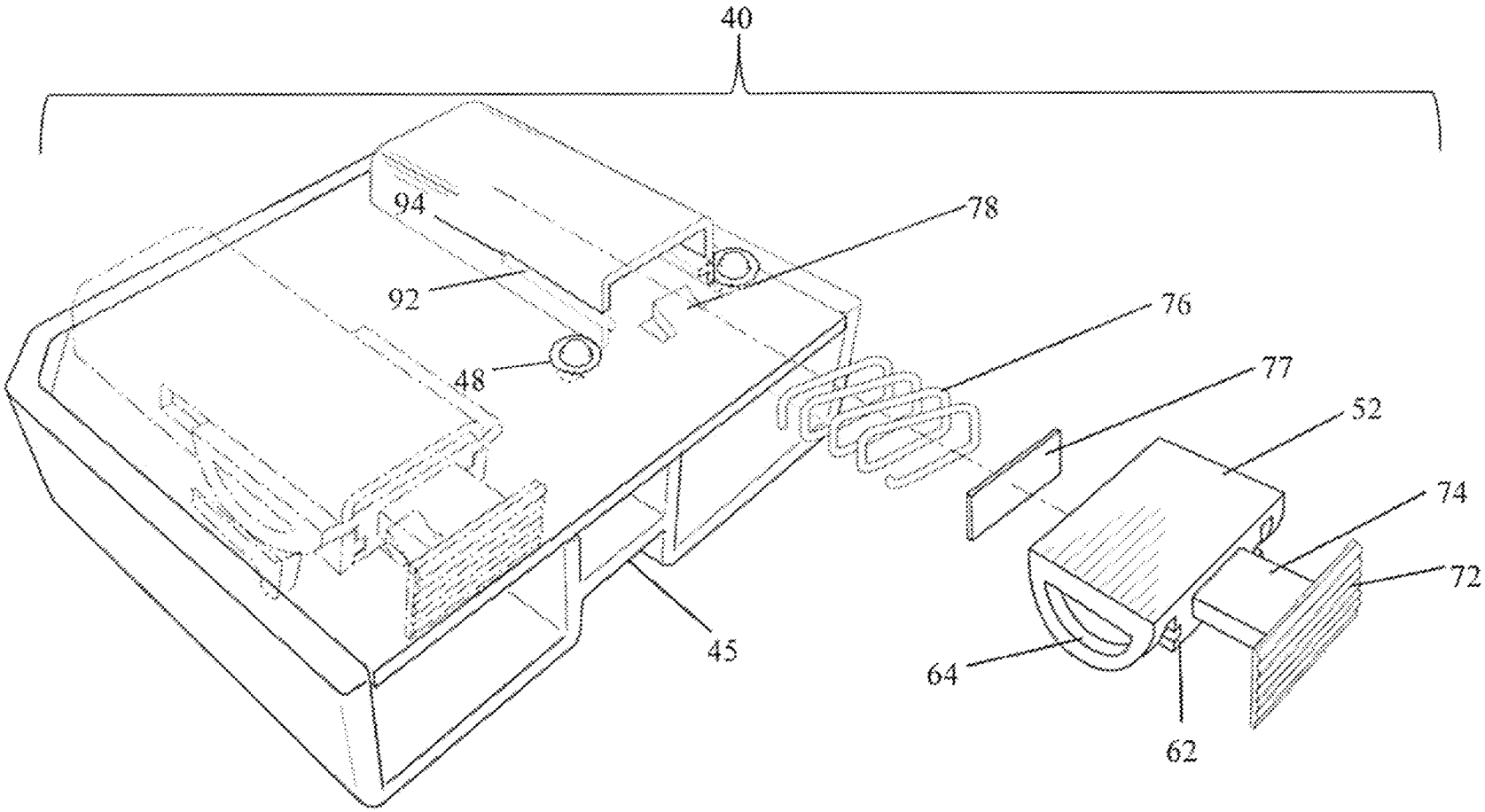
FIG. 21 is a partially exploded perspective view of a magazine pouch according to an embodiment of the present invention in which a retention element of the magazine pouch comprises a ball and spring assembly.

As depicted in the figures, the retention element 48 can comprise a flexible arm 58 cantilevered from a single engagement point with the main body 42 at one end of the flexible arm 58 and having a hook portion 56 at the opposite end of the flexible arm 58. As depicted in FIG. 20, in one embodiment, the retention element 48 can be flexibly affixed to the main body 42 at both ends of the arm 58 wherein the hook portion 56 is positioned between the ends of the arm 58. In this configuration, the shuttle 52 deforms the portion of the arm 58 at the hook portion 56 to move the hook portion 56 into engagement with the notch 28. As depicted in FIG. 21, In another embodiment, the retention element 48 can comprise a detent locking mechanism having a ball movable in an path of travel generally perpendicular to the linear path of travel in which the shuttle 52 travels. In this configuration, the shuttle 52 pushes the ball down into engagement with magazine 20 when the shuttle 52 is positioned in the locked or obstruction position. The retention element 48 can also comprise a spring for biasing the ball out of engagement with the magazine until the shuttle 52 pushes the ball into engagement with the magazine.

As depicted in FIGS. 7*a*-7*d*, 12*a*-12*c*, 13*a*-13*c* and 15-19, in operation, a magazine 20 can be slid into the slot 46 and the shuttle 52 moved into the locked position to bias the hook portion 56 into the slot 46 of the magazine 20. Each retention element 48 is positioned such that the hook portion 56 engages the magazine notch 28 or protrusion of a magazine 20 positioned in the engaged position to retain the magazine 20 within the slot 46. In one embodiment, the flexible arm or cantilevered spring 58 can be sized such that the hook portion or engagement member 56 can engage the base 34 of the magazine 20 or any other edge portion of magazine 20 generally transverse to the flexible arm 58 when the magazine 20 is inserted into the slot 46. In this configuration, the flexible arm 58 can comprise a rigid arm portion and a flexible end portion flexibly connected to the main body 42 such that the shuttle 52 can engage the rigid portion of the flexible arm 58 to prevent disengagement of the hook portion 56. In one embodiment, catch assembly 50 can comprise more than one retention element 48 for engaging each magazine notch 28 or protrusion of the magazine 20 as depicted in FIGS. 9, 10*a*-10*b*, 11*a*-11*b*, and 14*a*-14*b*. The shuttle 52 can be then slid into the unlocked position allowing the hook portion 56 to be moved into the disengaged position freeing the magazine 20 to be slid from the slot 46 unimpeded.

Figure 2:
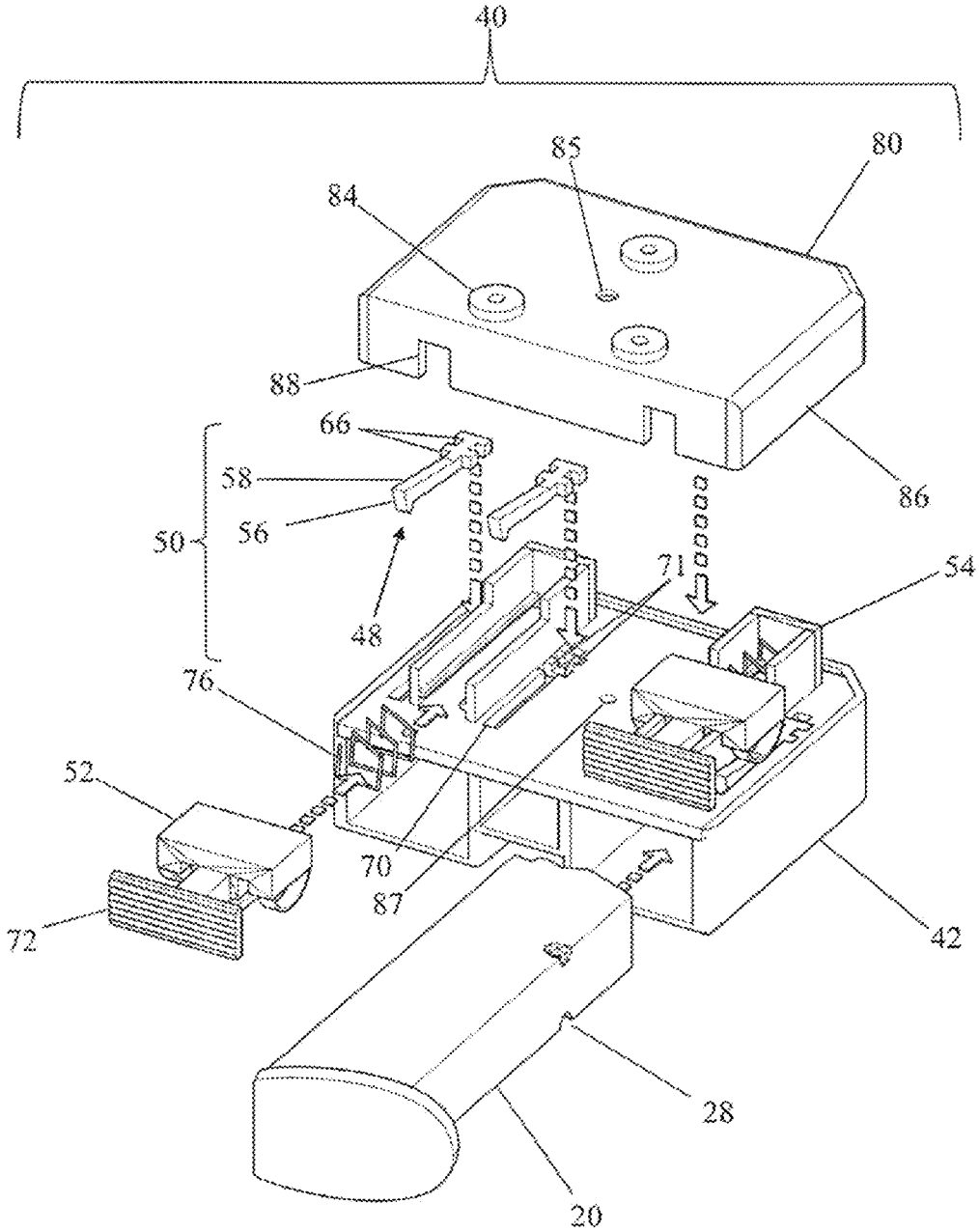
FIG. 2 is an exploded view of a magazine pouch according to an embodiment of the present invention.
Figure 3:
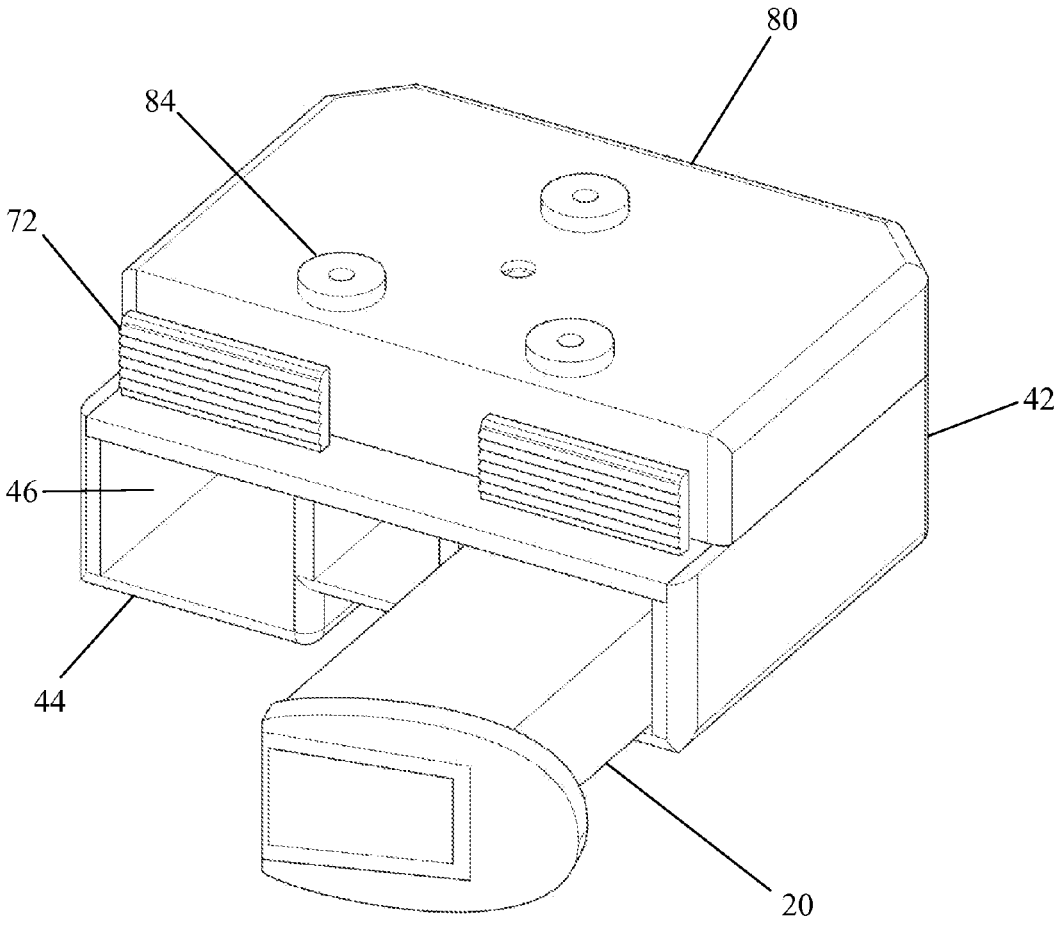
FIG. 3 is a perspective view of a magazine pouch depicted in FIG. 2.
Figure 4:
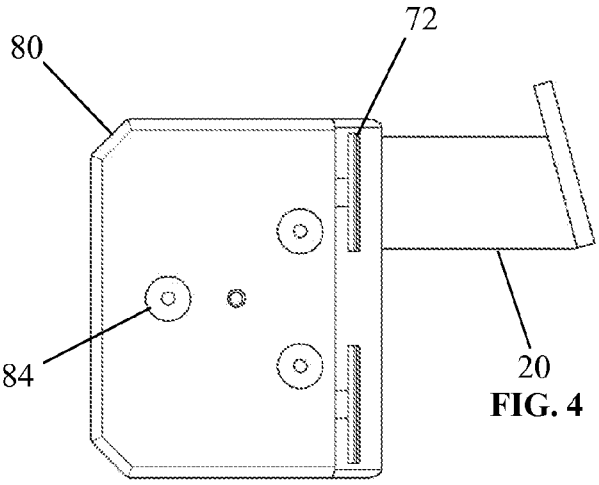
FIG. 4 is a top view of a magazine pouch depicted in FIG. 2.
Figure 5:
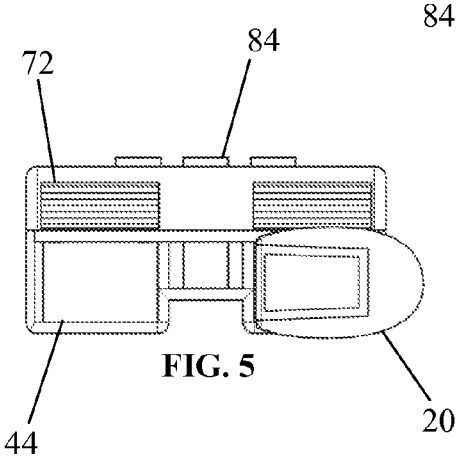
FIG. 5 is a front view of a magazine pouch depicted in FIG. 2.
Figure 6:
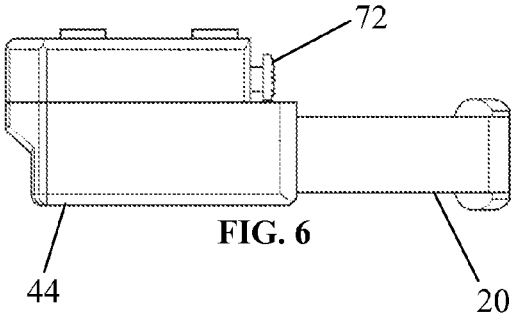
FIG. 6 is a side view of a magazine pouch depicted in FIG. 2.
Figure 9:
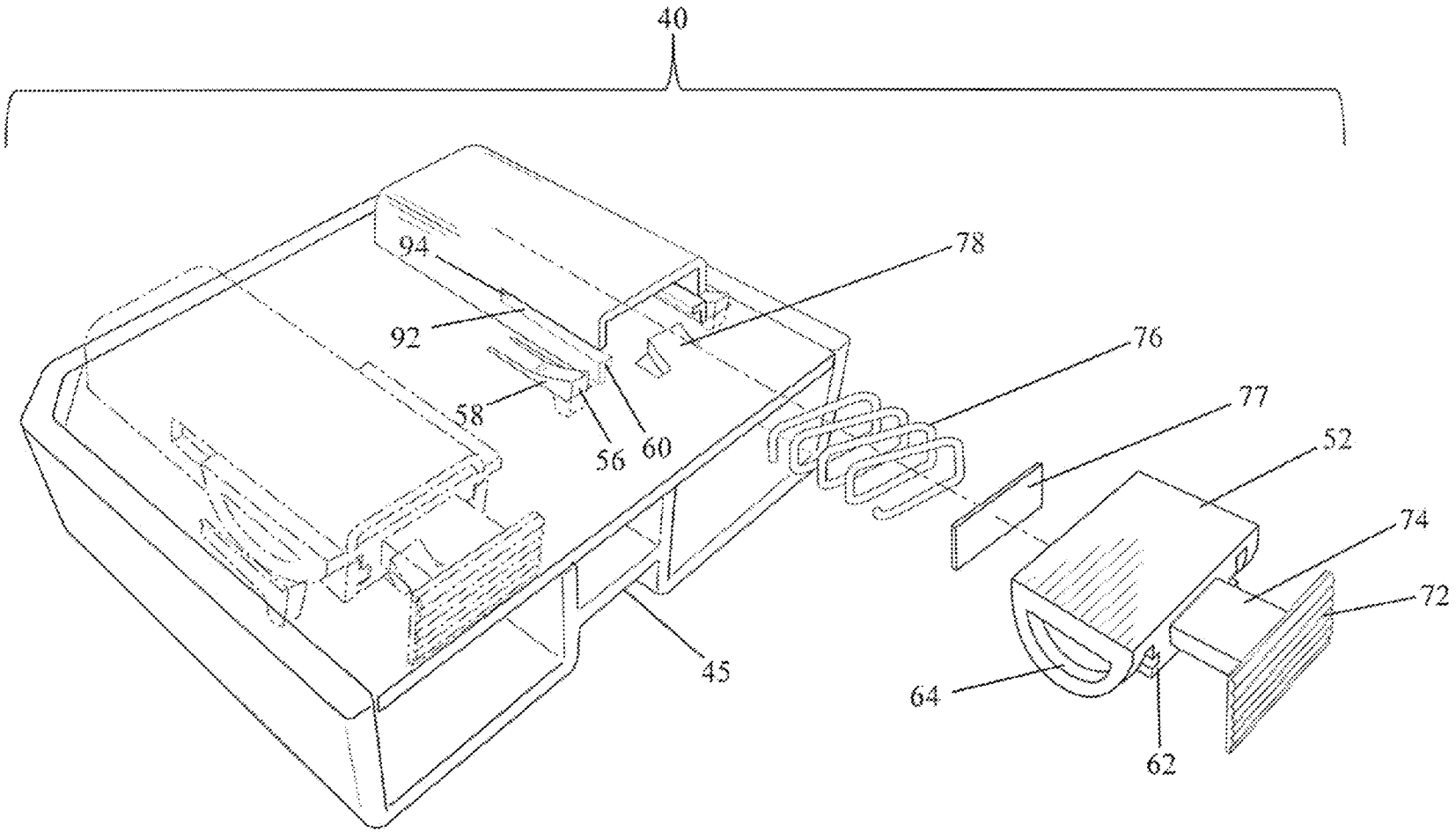
FIG. 9 is a partially exploded perspective view of a magazine pouch according to an embodiment of the present invention.
Figure 10A:
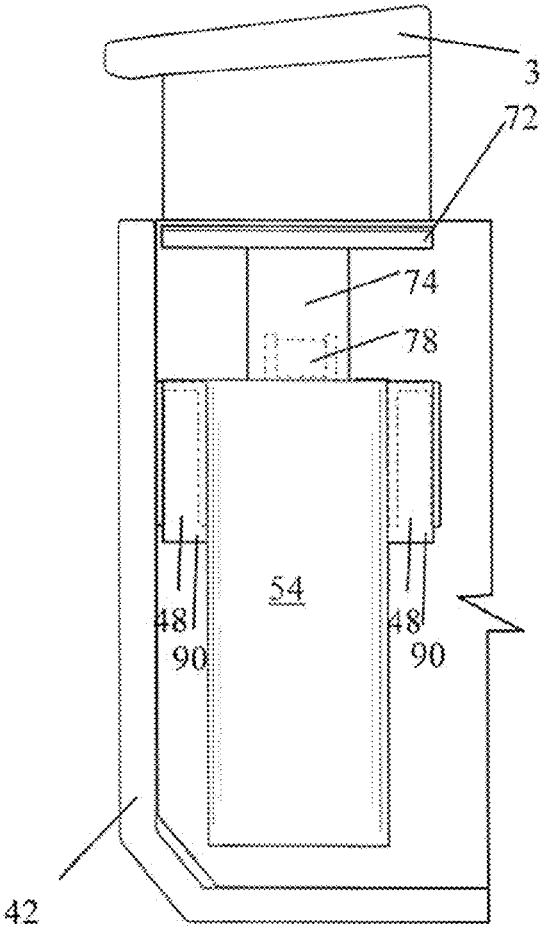
FIG. 10A is a top view of a catch assembly according to an embodiment of the present invention having a shuttle positioned in the locked position.
Figure 10B:
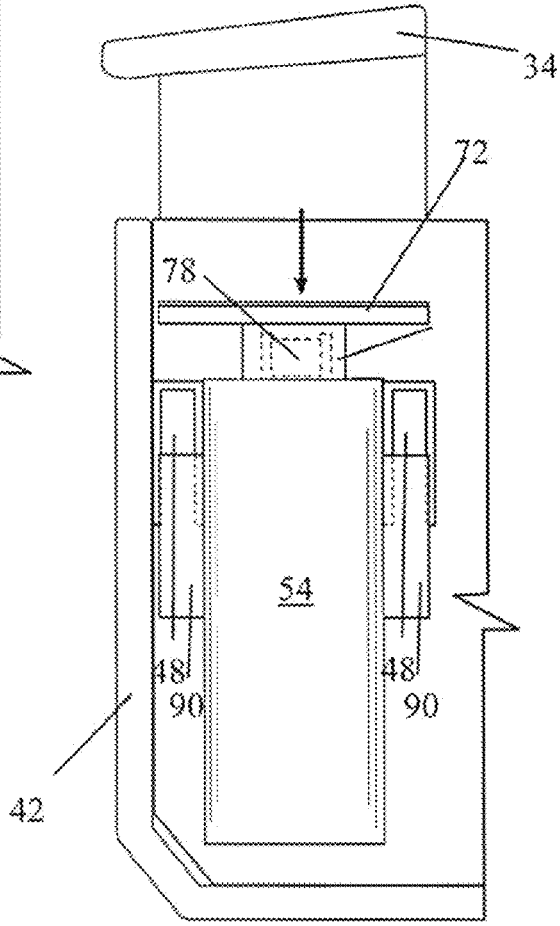
FIG. 10B is a top view of a catch assembly according to an embodiment of the present invention having a shuttle positioned in the unlocked position.

As depicted in FIGS. 2 and 9, in one embodiment, the shuttle 52 can comprise at least one secondary spring 64 corresponding to each retention element 48 for engaging the hook portion 56 when the shuttle 52 is slid into the locked position. The secondary spring 64 is tensioned to apply a sufficient force to the hook portion 56 to flex the flexible arm 58 and move the hook portion 56 into the engaged position when the shuttle 52 is in the locked position. In one embodiment, the secondary spring 64 comprises a folded spring having an arcuate shape in which the apex of the bend in the secondary spring 64 is engagable to the retention element 48. The limb portions of the secondary spring 64 can be affixed to the shuttle 52 or molded with the shuttle 52 as a unitary body. In this configuration, the bent limbs of the secondary spring 64 applies a force to the hook portion 56 of the retention element 48 to retain the hook portion 56 in the engaged or retention position.

During loading of the magazine 20 into the slot 46, the box 22 of the magazine 20 can push against the hook portion 56, wherein the secondary spring 64 flexes to provide controlled resistance to the hook portion 56 as the hook portion 56 is moved into the disengaged position as depicted in FIG. 7*b*. When the magazine notch 28 is aligned with the hook portion 56, the secondary spring 64 pushes the hook portion 56 back into the engaged position as depicted in FIG. 7*c*. In one embodiment, the hook portion 56 further comprises a tapered, inclined or rounded surface to engagement of the magazine 20 to hook portion 56 during insertion to flex the secondary spring 64 and move the hook portion 56 into the disengaged position. This arrangement allows the magazine 20 to be loaded into the slot 46 while the shuttle 52 is in the locked position such that the retention element 48 automatically secures the magazine 20 once the magazine 20 is properly seated. Similarly, this arrangement also allows use of the magazine pouch 40 in the dual retention element 48 configuration with magazines 20 that have a single magazine notch 28.

Figure 8:
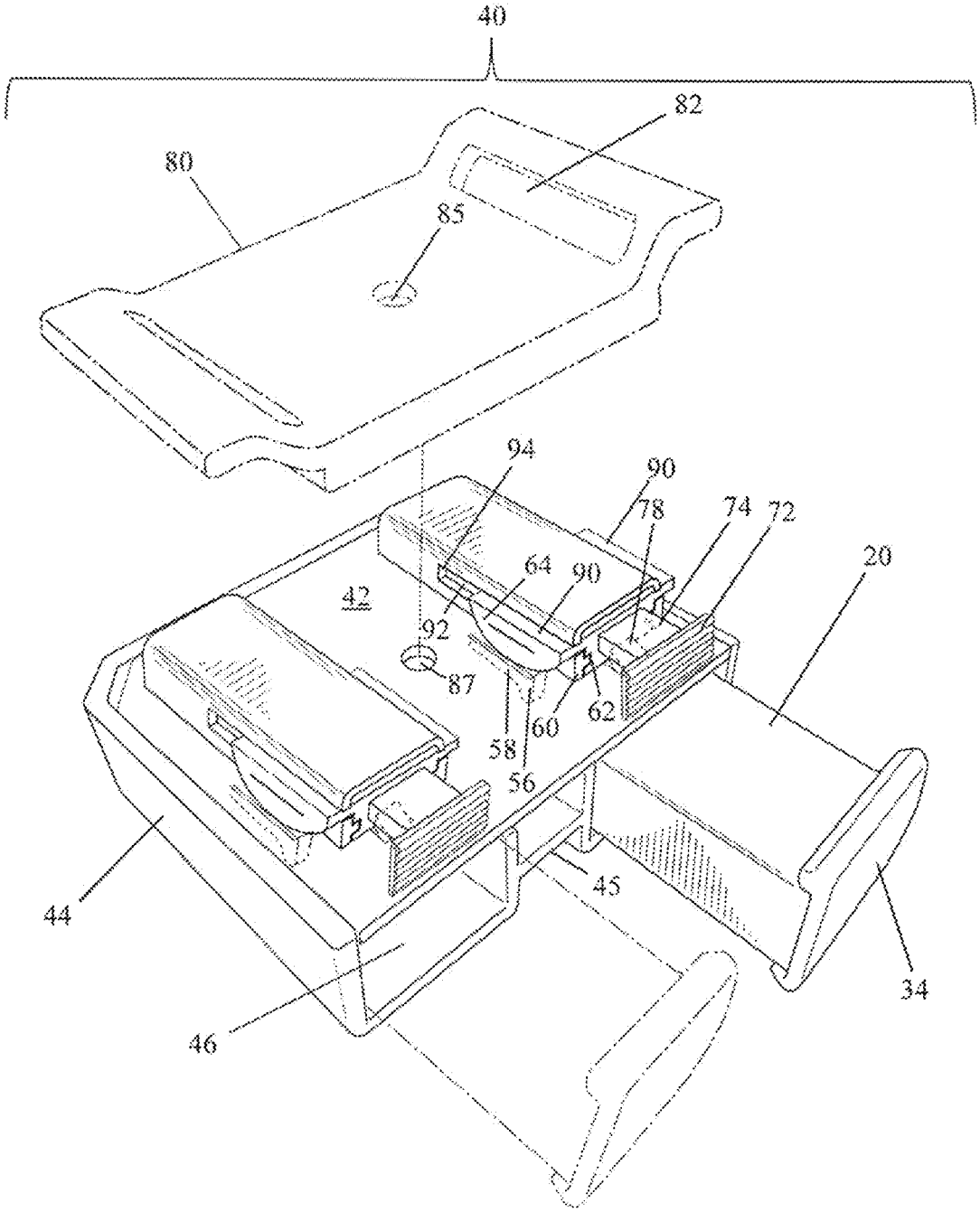
FIG. 8 is a partially exploded perspective view of a magazine pouch according to an embodiment of the present invention.

As depicted in FIGS. 8-9, in one embodiment, the retention element 48 is integrated the main body 42, wherein the flexible arm 58 is molded to or unitary with the main body 42 at one end. As depicted in FIG. 2, in another embodiment, the retention element 48 can comprise a separate piece wherein the retention element 48 is secured to the main body 42 during operation, but can be removed for replacement of the retention element 48 if the retention element 48 becomes damaged or deformed. In this configuration, the retention element 48 can comprise a plurality of locking protrusions 66 each having a tab. Similarly, the main body 42 defines a slot 70 for receiving the retention element 48 and a plurality of corresponding protrusions 71 having corresponding tabs to engage with the locking protrusions 66 of the retention element 48 to retain the retention element 48 within the slot 70.

In one embodiment, the retention element 48 can comprise a metal flexible arm or leaf spring 58 affixable to the main body 42 with fasteners, rivets, adhesives or conventional means of securing a metal element to a rigid body. Similarly, in one embodiment, the hook portion 56 can comprise a separate metal component affixed to the metal flexible arm 58. Alternatively, in another embodiment, the hook portion 56 can be formed with the metal flexible arm 58 as a unitary body. In yet another embodiment, the hook portion 56 can comprise a polymer component overmolded onto the flexible arm 58.

Figure 11A:
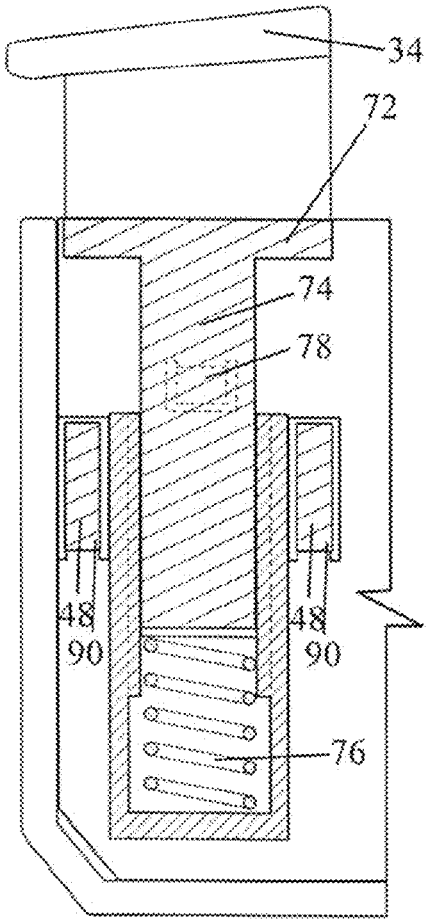
FIG. 11A is a cross-sectional side view of a catch assembly according to an embodiment of the present invention having a shuttle positioned in the locked position.
Figure 11B:
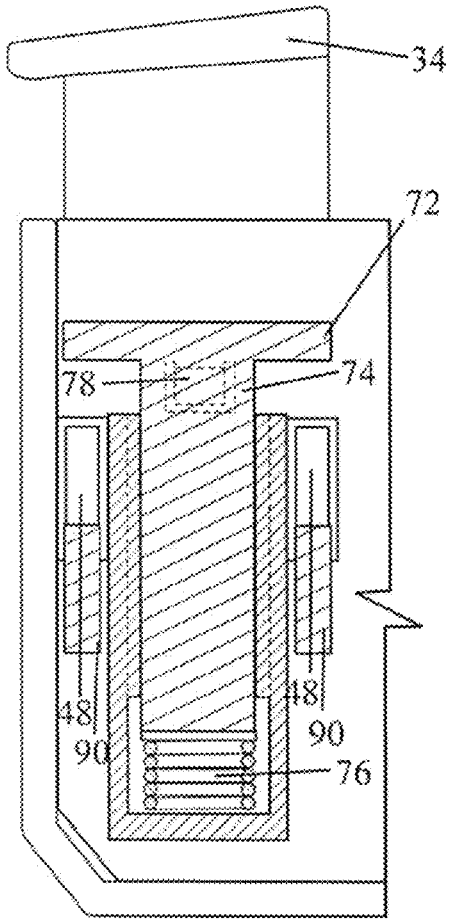
FIG. 11B is a cross-sectional side view of a catch assembly according to an embodiment of the present invention having a shuttle positioned in the unlocked position.

As depicted in FIGS. 2-6 and 8-9, in one embodiment, the shuttle 52 can further comprise a button 72 on one side of the shuttle 52 that can be depressed by a user to move the shuttle 52 into the unlocked position. In one embodiment, the shuttle 52 can further comprise a shaft 74 to which the button 72 is affixed to position the button 72 in reachable position as depicted in FIGS. 11*a*-11*b*. The catch assembly 50 can further comprise a spring 76 positioned within the catch assembly housing 54 opposite the button 72. In one embodiment, a follower 77 can be positioned between the spring 76 and the shuttle 52. In operation, depressing the button 72 to move the shuttle 52 into the unlocked position compresses the spring 76 such that the spring 76 is biased to return the shuttle 52 to the locked position when the button 72 is released. In one embodiment, the main body 42 further comprises a stop 78 preventing the spring 76 from moving the shuttle 52 past the locked position when returning the shuttle 52 to the locked position as depicted in FIGS. 2, 9 and 11*a*-11*b*.

Figure 18:
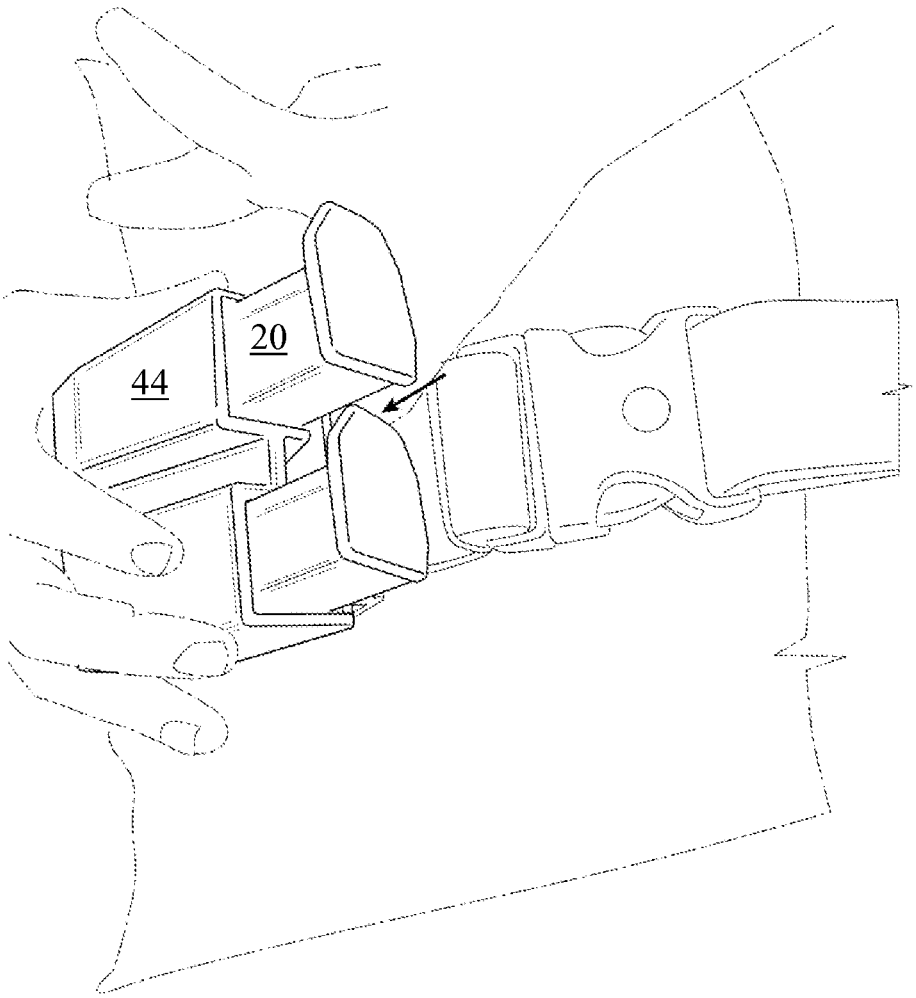
FIG. 18 is a perspective view of the magazine pouch disclosed herein worn by the user in a horizontally oriented configuration such that the magazine resides within the magazine pouch in a position parallel to the user's belt.
Figure 19:
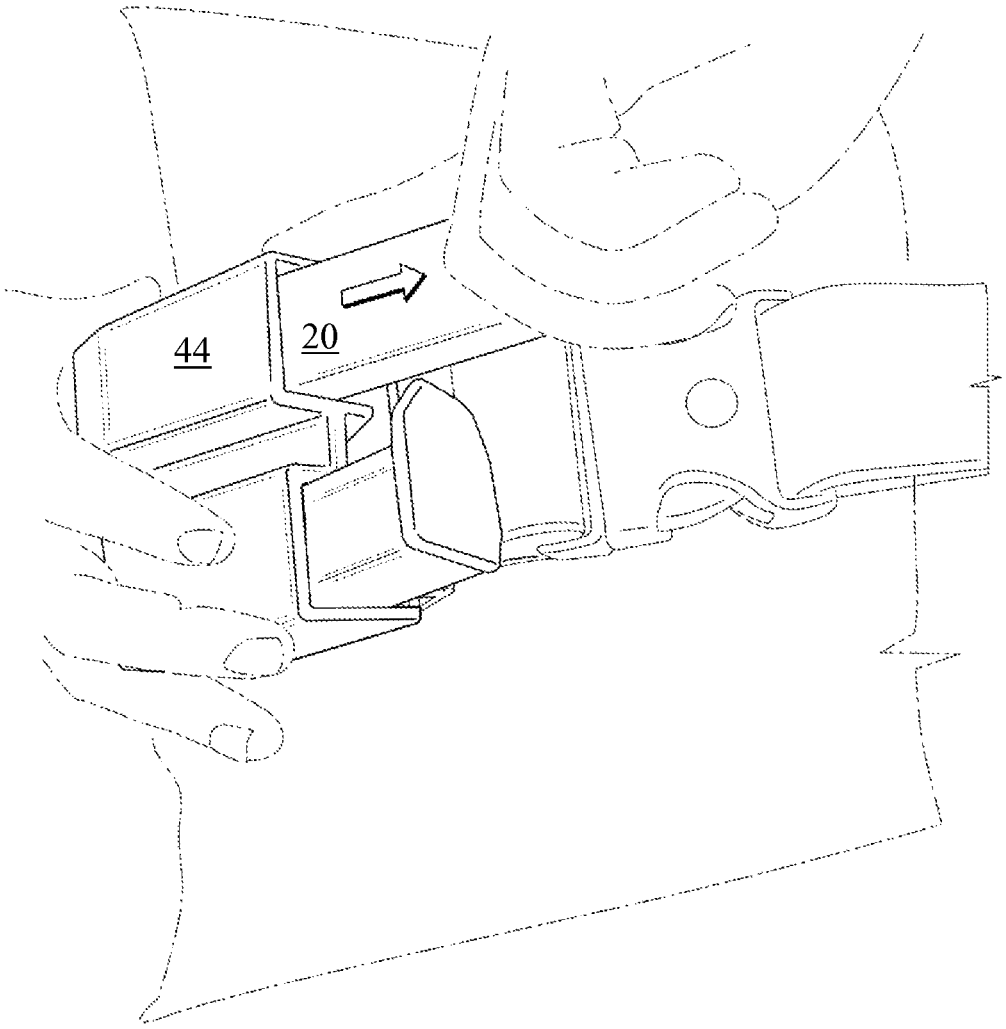
FIG. 19 is a perspective view of the magazine pouch disclosed herein worn by the user in a horizontally oriented configuration such that the magazine resides within the magazine pouch in a position parallel to the user's belt and being manually removed by the user.

As depicted in FIGS. 2, 8 and 18-19, in one embodiment, the magazine pouch 40 can further comprise an attachment buckle 80 for securing the magazine pouch 40 to clothing, belt or holster platform. The attachment buckle 80 can comprise belt loops 82 as depicted in FIG. 8, engagement points 84 for holster platforms as depicted in FIG. 2, a horizontal belt loop arrangement for orienting the magazines 20 horizontally as depicted in FIGS. 18-19, strap loops for shoulder harnesses and other means of securing magazine pouches 40 to clothing and equipment. In one embodiment, the attachment buckle 80 defines a screw hole 85 for receiving a fastener to secure the attachment buckle 80 to the main body 42 as depicted in FIGS. 2 and 8. In this configuration, the main body 42 defines a screw hole 87 corresponding to the screw hole 85 of the attachment buckle 80.

As depicted in FIGS. 2 and 8, in one embodiment, the buckle 80 can be secured to the main body 42 such that the buckle 80 rests on the catch assembly housings 54. As depicted in FIG. 2, in another embodiment, the attachment buckle 80 can also comprise walls 86 extending around the catch assemblies 50. In this configuration, the walls 86 can define a plurality of notches 88 for receiving the shafts 74 such that the button 72 can be positioned outside the walls 86. This arrangement prevents the catch assemblies 50 from being caught on the clothing or equipment during operation and jamming or otherwise malfunctioning.

As depicted in FIG. 8, in one embodiment, the shuttle 52 comprises wings 90 extending outward past the catch assembly housing 54. In this configuration, the secondary springs 64 are positioned on the wings 90, wherein the retention elements 48 are also positioned outside the catch assembly housing 54. Similarly, the catch assembly housing 54 can define a notch 92 for receiving the wings 90 as the shuttle 52 is moved between the locked and unlocked positions, wherein the notch 92 comprises a closed end 94 engagable to the wings 90 to prevent the shuttle 52 from being slid past the predefined unlocked position.

A method of retaining a magazine 20 within a magazine pouch 40, according to an embodiment of the present invention, comprises providing a slot 46, a shuttle 52 and a retention element 48 having a hook portion 56 and a flexible arm 58. The method further comprises positioning the shuttle 52 in a first position in which the shuttle 52 is disengaged from the hook portion 56. The method also comprises sliding the magazine 20 into the slot 46 such that a magazine notch 28 aligns with the hook portion 56. The method further comprises sliding the shuttle 52 into a second position in which the shuttle 52 is engaged to the hook portion 56 causing to the flexible arm 58 to flex and position the hook portion 56 within the magazine notch 28 to lock the magazine 20 within the slot 46. The method also comprises sliding the shuttle 52 back to the first position allowing the flexible arm 58 to position the hook portion 56 out of engagement with the magazine notch 28 allowing removal of the magazine 20 from the slot 46.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims. For the purposes of this disclosure and claims, "connected" does not necessarily require direct component to component connect, but can include intermediate elements linking the components.

The invention claimed is:

1. A wearable magazine pouch for receiving a magazine having a magazine notch, comprising:

a main body having at least one magazine housing defining a slot for a portion of the magazine, wherein the portion of the magazine received within the slot defines the magazine notch; and a catch assembly corresponding to each magazine housing and comprising:

a retention element having a hook portion positioned on a flexible arm, wherein flexing the flexible arm moves the hook portion between an engaged position in which the hook portion extends into the slot to engage the magazine notch of the magazine and a disengaged position in which the hook portion is retracted from the slot disengaging the hook portion from the magazine, wherein the flexible arm is biased to position the hook portion in the disengaged position, a shuttle movable along a linear path of travel generally parallel to the flexible arm between a locked position and an unlocked position, wherein the shuttle engages the hook portion when slid into the locked position to flex the arm and position the hook portion in the engaged position, wherein sliding the shuttle into the unlocked position disengages the shuttle from the hook portion allowing the flexible arm to move the hook portion into the disengaged position.

2. The magazine pouch of claim 1, wherein the catch assembly further comprises a catch assembly housing comprising a rail engagable by the shuttle, wherein the rail provides the linear path as the shuttle is slid between the locked position and the unlocked position.

3. The magazine pouch of claim 1, wherein the shuttle comprises a runner slidably engagable to the rail.

4. The magazine pouch of claim 1, wherein the shuttle further comprises a secondary spring for engaging the hook portion of the retention element to obstruct the hook portion from moving from the engaged position, wherein the secondary spring is flexible to allow the hook portion to move into the disengaged position as the magazine is slid into the slot until the hook portion aligns with the magazine notch.

5. The magazine pouch of claim 4, wherein the secondary spring comprises an arcuate shape having two limb portions and an apex between the limb portions, wherein apex is engagable to the hook portion and the limb portions are bent to provide a force pushing the hook portion into the engaged position when the apex engages the hook portion.

6. The magazine pouch of claim 4, wherein the hook portion comprises a tapered surface engagable by the magazine to push the hook portion into the disengaged position.

7. The magazine pouch of claim 1, wherein the shuttle further comprises a button for applying a first force to the shuttle parallel to the linear path of travel to slide the shuttle from the locked position to the unlocked position.

8. The magazine pouch of claim 7, wherein the shuttle further comprises an elongated shaft on which the button is positioned.

9. The magazine pouch of claim 7, wherein the catch assembly housing further comprises a spring for applying a second force to the shuttle parallel to the linear path of travel to slide the shuttle from the unlocked position to the locked position, wherein the second force is opposite the first force.

10. The magazine pouch of claim 1, further comprising an attachment buckle defining a first screw hole for receiving a fastener, wherein the main body defines a second screw hole corresponding to the first screw hole such that the fastener can be inserted through the first and second screw holes to secure the attachment buckle to the main body.

11. The magazine pouch of claim 10, wherein the attachment buckle further comprises at least one belt loop.

12. The magazine pouch of claim 10, wherein the attachment buckle further comprises at least one attachment point for a holster platform.

13. The magazine pouch of claim 10, wherein the attachment buckle further comprises a wall encircling the catch assembly, wherein the wall defines at least one opening for applying a force to the shuttle to move the shuttle from the locked position into the unlocked position.

14. A wearable magazine pouch for securing a magazine therein and allowing controlled release of the magazine, the magazine comprising a box with a mouth for receiving a plurality of cartridges, a closed opposite end, and a notch there between, the pouch comprising:

a magazine housing with a slot sized to conformingly receive the magazine;

a retention member attached to the housing and movable between an retention position and a release position, the retention member having a magazine engagement portion, whereby when the retention member is in the retention position, the engagement member is positioned to seat in the notch on the magazine when the magazine is in the slot, whereby when the retention member is in the release position the engagement member is in a position to not seat in the groove in the magazine; and a moveable shuttle member which is moveable between an obstructing position and a non obstructing position with respect to the retention member, whereby in the obstructing position, the movement of the engagement member from the retention position to the release position is obstructed;

wherein the moveable shuttle member comprises a secondary spring member to provide a controlled resistance to the retention member moving to the release position when the shuttle member is in the obstructing position.

15. The magazine pouch of claim 14, wherein the retention member is biased toward the retention position.

16. The magazine pouch of claim 14, wherein the shuttle member has a push button attached thereto allowing the shuttle member to be moved from the retention position to the release position by a wearer of the pouch.

17. The magazine pouch of claim 14, wherein the secondary spring member comprises an arcuate shape having two limb portions and an apex between the limb portions, wherein apex is engagable to the engagement portion and the limb portions are bent to provide a force pushing the engagement portion into the retention position when the apex engages the engagement portion.

18. The magazine pouch of claim 14, wherein the retention member comprises a cantilevered leaf spring, the engagement member being at a cantilevered end of the leaf spring.

19. The magazine pouch of claim 18, wherein the engagement member has an inclined or rounded surface that engages the magazine case when the case is inserted into the slot while the retention member is in the retention position to urge the retention member to the release position whereby the magazine can be fully inserted into the slot of the pouch.

20. A wearable magazine pouch for receiving a magazine, comprising:

a magazine housing defining a slot for receiving at least a portion of the magazine; and a catch assembly comprising;

a catch assembly housing extending from the magazine housing;

a retention element disposed within the catch assembly housing having an engagement feature movable along a first path of travel between a retention position in which the engagement feature is positioned to be engageable with the magazine inserted into the slot and a release position in which the engagement feature is not engagable with the magazine, and a shuttle element disposed within the catch assembly housing and movable along a second path of travel transverse to the first path of travel between an obstructing position in which the shuttle element engages the retention element to maintain the engagement feature in the retention position and a non-obstructing position in which the shuttle element does not maintain the engagement feature in the retention position allowing the engagement feature to move into the release position, the shuttle element including a shaft having a push button on one end, the push button presenting a major face defining a normal vector thereto, said normal vector having a component that is parallel to the second path of travel, the shaft extending outside the catch assembly housing so that the push button is outside the catch assembly housing.

21. The magazine pouch of claim 20, wherein the engagement feature is biased into the release position.

22. The wearable magazine pouch of claim 20, wherein the normal vector of the major face of the push button is substantially parallel to the path of travel of the shuttle element.

23. The wearable magazine pouch of claim 20, wherein the shuttle element includes a shaft that extends parallel to the second path of travel to which the push button is affixed to position the push button in reachable position.

24. The wearable magazine pouch of claim 20, further comprising a wall that surrounds the catch assembly housing, the wall defining a notch, the shaft of the shuttle extending through the notch so that the push button is outside the wall.

25. The wearable magazine pouch of claim 20, further comprising a spring operatively coupled to the shuttle element that biases the shuttle element in the obstructing position.

26. The magazine pouch of claim 20, wherein the retention element further comprises an elongated flexible arm flexibly attached to the main body at one end of the flexible arm.

27. The magazine pouch of claim 26, wherein the engagement feature is positioned at the opposite end of the flexible arm.

28. The magazine pouch of claim 26, wherein the flexible arm is flexibly attached to the main body at both ends of the flexible arm, wherein the engagement feature is positioned on the flexible arm between the ends of the arm.

29. The magazine pouch of claim 26, wherein the retention element further comprises a detent, wherein the engagement feature comprises a ball movable within the detent along the first path of travel.

30. The magazine pouch of claim 29, wherein the retention element further comprises a spring positioned within the detent biasing the ball out of release position.

31. A wearable magazine pouch, comprising:

a magazine housing defining a slot for receiving at least a portion of the magazine;

an attachment buckle operatively coupled to the magazine housing;

a catch assembly disposed between the magazine housing and the attachment buckle, the catch assembly comprising:

a retention element including an engagement feature selectively movable between a retention position in which the engagement feature is positioned to be engageable with the magazine inserted into the slot and a release position in which the engagement feature is not engagable with the magazine, and a shuttle element movable along a path of travel between an obstructing position in which the shuttle element engages the retention element to maintain the engagement feature in the retention position and a non-obstructing position in which the shuttle element does not maintain the engagement feature in the retention position enabling the engagement feature to move into the release position, the shuttle element being biased in the obstructing position, the shuttle element including a shaft having a push button on one end; and a wall that extends between the attachment buckle and the magazine housing, the wall defining a notch, wherein the shaft extends through the notch and parallel to the path of travel so that the push button is outside the wall.

32. The wearable magazine pouch of claim 31, wherein the catch assembly housing is integrally formed with the magazine housing.

* * * * *

UNITED STATES PATENT AND TRADEMARK OFFICE

CERTIFICATE OF CORRECTION

PATENT NO. : 8,887,972 B2
APPLICATION NO. : 13/691617
DATED : November 18, 2014
INVENTOR(S) : Solomon It is certified that error appears in the above-identified patent and that said Letters Patent is hereby corrected as shown below:

On the Title Page, Column 1, item (51), under "Int. Cl.",
delete "*F42B 39/26* (2006.01)
*F42B 39/02* (2006.01)
*F42B 39/22* (2006.01)" and
insert -- *F42B 39/26* (2006.01) --, therefor.

On the Title Page, Column 1, item (52), under "U.S. Cl.",
delete "CPC ..... *F42B 39/26* (2013.01); *F42B 39/02* (2013.01); *F42B 39/22* (2013.01); *Y10S 224/931* (2013.01)" and
insert -- CPC .....*F42B 39/26* (2013.01); *F42B 39/02* (2013.01); *F42B 39/22* (2013.01) --, therefor.

On the Title Page, Column 2, item (57), Line 2, under "ABSTRACT", delete "engagable" and insert -- engageable --, therefor.

In the Claims

In Column 11, Claim 2, Line 24, delete "engagable" and insert -- engageable --, therefor.

In Column 11, Claim 3, Line 28, delete "engagable" and insert -- engageable --, therefor.

In Column 11, Claim 5, Line 38-39, delete "engagable" and insert -- engageable --, therefor.

In Column 11, Claim 6, Line 43, delete "engagable" and insert -- engageable --, therefor.

In Column 12, Claim 14, Line 14, delete "an retention" and insert -- a retention --, therefor.

Signed and Sealed this
Sixteenth Day of June, 2015

Michelle K. Lee

Michelle K. Lee
*Director of the United States Patent and Trademark Office*

In Column 12, Claim 14, Line 27, delete “obstructed;” and insert -- obstructed, --, therefor.

In Column 12, Claim 17, Line 41, delete “engagable” and insert -- engageable --, therefor.

In Column 12, Claim 20, Line 58, delete “comprising;” and insert -- comprising: --, therefor.

In Column 12, Claim 20, Line 67, delete “engagable” and insert -- engageable --, therefor.

In Column 14, Claim 31, Line 23, delete “engagable” and insert -- engageable --, therefor.